US005510805A

United States Patent [19]

Lee

[11] Patent Number: 5,510,805

[45] Date of Patent: Apr. 23, 1996

[54] SCANNING CIRCUIT

[75] Inventor: Sywe N. Lee, Taipei, Taiwan

[73] Assignee: Prime View International Co., Hsinchu, Taiwan

[21] Appl. No.: 453,495

[22] Filed: May 30, 1995

Related U.S. Application Data

[63] Continuation-in-part of Ser. No. 287,499, Aug. 8, 1994, abandoned.

[51] Int. Cl.[6] ..... G09G 3/36

[52] U.S. Cl. ..... 345/58; 345/99; 345/100; 345/197

[58] Field of Search ..... 345/99, 100, 58, 345/197, 87

[56] References Cited

U.S. PATENT DOCUMENTS

| | | | |
|---|---|---|---|
| 5,034,735 | 7/1991 | Inoue | 345/96 |
| 5,113,181 | 5/1992 | Inoue | 345/100 |
| 5,157,386 | 10/1992 | Uchida | 345/89 |
| 5,313,222 | 5/1994 | Lee | 345/100 |
| 5,376,944 | 12/1994 | Mogi | 345/100 |

*Primary Examiner*—Richard Hjerpe
*Assistant Examiner*—Kent Chang
*Attorney, Agent, or Firm*—H. C. Lin

[57] ABSTRACT

A row select driver circuit is used to energize each pixel row sequentially of a liquid crystal display. The output of each row select driver circuit is connected to a corresponding pixel row line and to a succeeding row select driver circuit as an activating input. All the row select driver circuits are integrated with thin-film transistors and deposited on the same glass substrate as the pixels. The number of leads connected to the assembly is much less than the number of pixel rows, including two sets of overlapping clock signals (three each for odd-numbered rows and even-numbered rows offset by one scanning line time) with different pulse-widths and periods twice as long as the scanning line time, a clock signal with a period as long as the scanning line time, a shift-in signal, a positive power supply terminal and at least one ground. These long clock periods precharge the following stage so as to effect a faster deselect time by overcoming the long time constant due to the high series of the thin-film transistors. In one example, the number of leads is reduced from 240 to 11.

11 Claims, 4 Drawing Sheets

SCANNING CIRCUIT

This application is a continuation-in-part, of application Ser. No. 08/287,499, filed Aug. 8, 1994, now abandoned.

BACKGROUND OF THE INVENTION

This invention relates to a driver circuit for an active matrix display device, and particularly a row select driver circuit for driving the pixel rows of a liquid crystal display (LCD) using thin-film transistors (TFT).

Liquid crystal display (LCD) or similar devices normally use thin-film MOS transistors deposited on a substrate, usually glass. At present, almost all commercially available active matrix liquid displays (AMLCD) are unscanned in that the scanning signal is applied external to the AMLCD.

An unscanned AMLCD requires one external lead for each column and row line. For example, a direct line interface driver for a black and white 768X1024 XGA computer display would require 1792 leads. The need for this large number of leads in the display drivers is a serious problem, which gets worse as the resolution and complexity of displays increase. Two major challenges are to reduce the number of required input leads and to "integrate" the driver circuitry onto the display substrate.

U.S. Pat. No. 5,034,735 discloses a driving apparatus using two transistors per pixel row for producing select and deselect signals and sequentially addressing them through the control gates. However, the scanning driver circuit and a signal driver circuit are adapted for a ferroelectric liquid crystal device, not for TFT-LCD.

U.S. Pat. No. 5,157,386 discloses a circuit driving an AMLCD with video digital data of K bits. An analog switch receives a video voltage and outputs the video voltage to each column when the analog is turned on by a control signal. This is not a circuit for selectively driving the rows of a display.

U.S. Pat. No. 5,113,181 discloses a display, wherein a data driver demultiplexer is used, but does not disclose a scan driver circuit.

U.S. Pat. No. 5,313,222 discloses a select driver circuit for an LCD display, which has to sustain a great deal of electrical stress.

SUMMARY OF THE INVENTION

It is an object of the present invention to reduce the manufacturing cost and to increase reliability by eliminating the need for mounting integrated circuits on a separate substrate. It is another object of the present invention to produce a novel row select driver circuit which can be integrated directly onto the display substrate, thereby eliminating the cost of peripheral ICs and hybrid assembly needed in an unscanned AMLCD. Still another object of the present invention is to produce a new integrated row select driver circuit with faster deselect time and full amplitude drive signal to overcome the long time constant due to the high series resistance of the thin-film transistors. A further object of this invention is to reduce the power consumption of the row select driver circuit.

These objects are achieved by using a row select driver circuit similar to a shift register. Each row select driver circuit energizes a row of pixels. The row select driver circuits are deposited on the glass substrate of the pixels. The output of each row select driver circuit is connected to a corresponding pixel row line and to a succeeding row select driver circuit as an activating input. These row select driver circuits energize the pixel row sequentially. Switching apparatus external to the display device has leads connected to the row select driver circuits wherein the number of leads is far less than the number of pixel rows. In one example, the number of leads is reduced from 240 to 11.

Each of the row select driver includes a number of thin-film transistors formed on the display substrate, and interconnected to cause sequential activation of each pixel row.

A first row select driver circuit stage activates a first pixel row for a first predetermined period of time. A second adjacent row select driver circuit activates a subsequent pixel pixel row for a second predetermined period of time prior to the termination of the first predetermined period of time such that a longer row select time is provided for each row to charge or discharge the pixels of the corresponding pixel row. In so doing, a faster deselect time is achieved to overcome the slow time constant due to the high series resistance of the thin-film transistors. The timing for the row select driver is achieved with a control clock with a period equal to the scanning line time and two sets of three overlapping control clocks of different pulsewidths having a period twice as long of the scanning line time. The two sets of clocks are used respectively for odd-numbered stages and even-numbered stages and are offset by one scanning line period.

DETAILED DESCRIPTION OF THE PREFERRED EMBODIMENT

Figure 1:
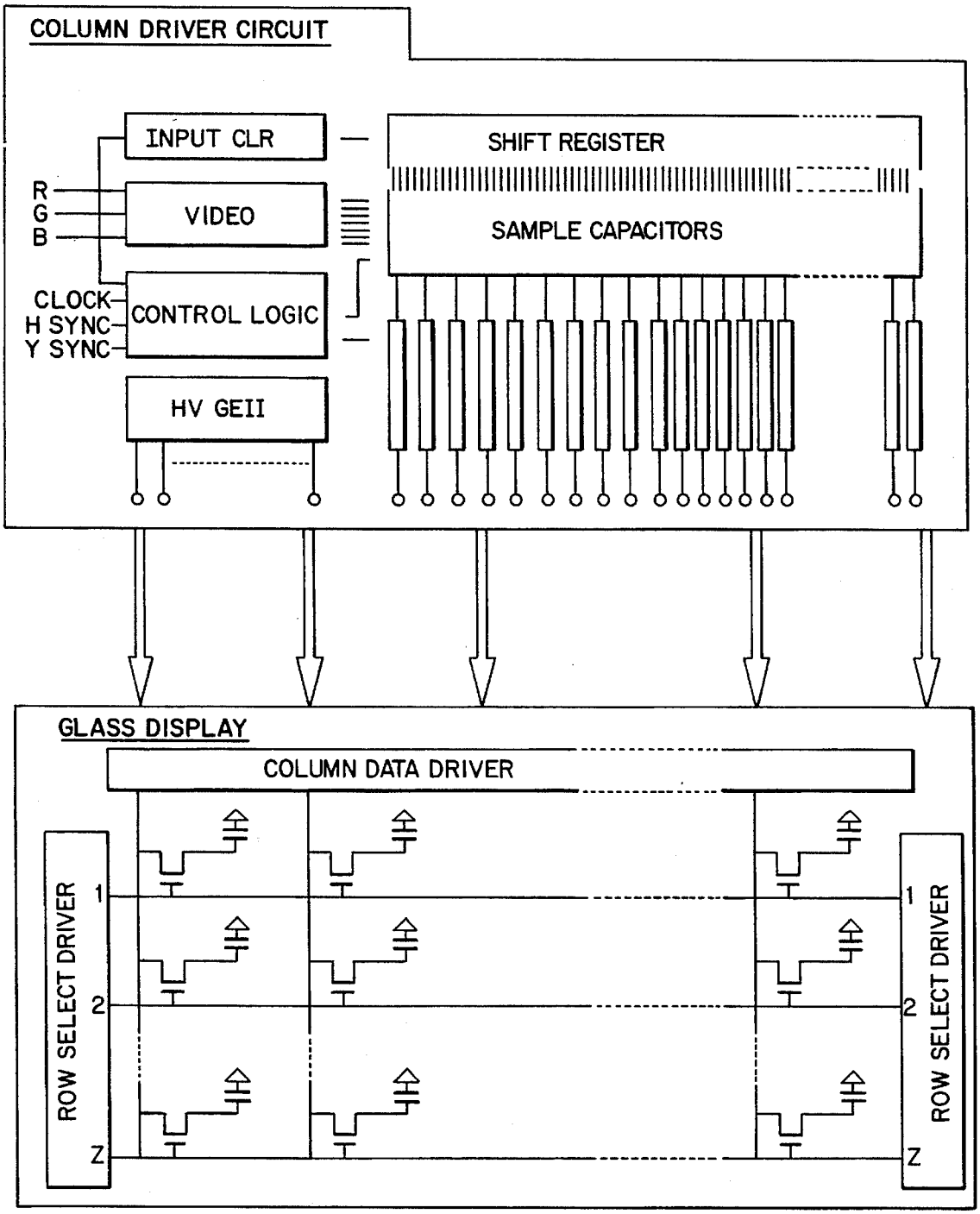
FIG. 1 is a block diagram of a display system in which the row select driver circuit of the present invention may be used.

This invention will be described with a 384×240 pixel array color TV as an example. FIG. 1 shows a block diagram of a display system in which the row select driver circuit of the present invention may be included. The top block in FIG. 1 shows an external driving system, which includes the circuits of control logic signal generator, sample-and-hold, etc., to the display device. The display device is shown as a block in the bottom of FIG. 1. The block labeled "row select driver" represents the present invention and is shown coupled only to the first two rows and the last row of the pixel matrix array.

Figure 2:
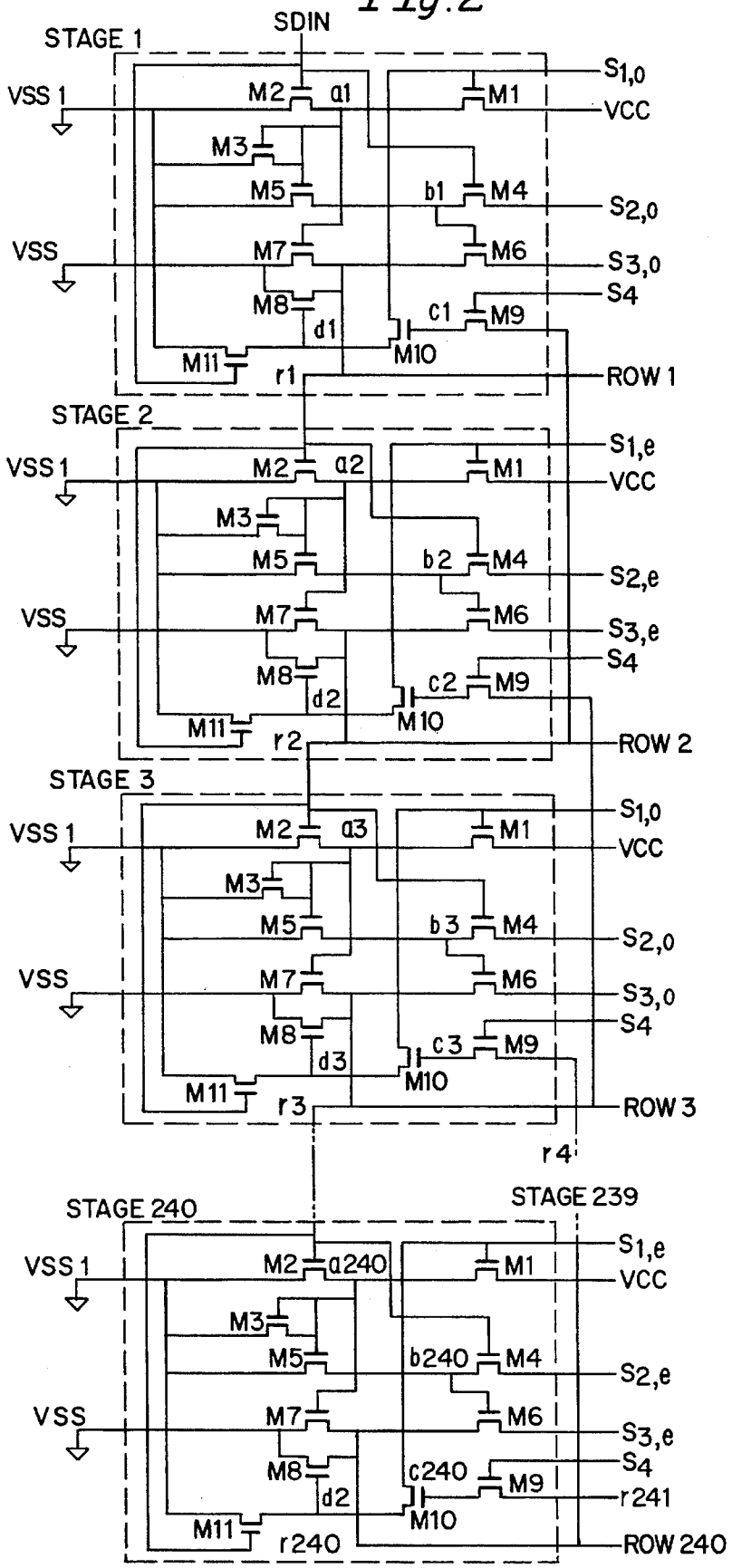
FIG. 2 is a schematic diagram in accordance with the present invention.

The details of the row select driver circuit of the present invention are shown in FIG. 2, where all of the input and power supply signals are fed from external driving system shown in the top block. It should be noted that the row select driver circuit, though shown only on one side of the display device in FIG. 1, could also include a second identical row select driver circuit connected to the pixel row lines on the opposite side of the display device. This second row select driver circuit would provide circuit redundancy and enhance circuit diagnosis when repairs are necessary.

There are 240 identical stages of sub-circuit in a row select driver circuit for this example as shown in FIG. 2. Each driver circuit stage is indicated by a rectangular dashed line and labeled as stage 1, stage 2, and stage 3 through stage 240. All stages are identical except where the input of each stage is connected to the output of the preceding stage. The drain electrode of the field effect transistor M9 is connected to the output (e.g. ROW2, ROW3, etc.) of the +succeeding stage and the odd (even) control signals such as S1,o, S2,o, and S3,o (S1,e, S2,e, and S3,e) are connected to the odd (even) stages. The row select driver circuit is preferably fabricated with thin-film transistors (TFT) on the display device substrate to generate scanning signals for the display to turn on and off a selected row of pixel transistors.

This invention is particularly focused on reducing the number of external lead connections to the row driver circuits to 11 from a number such as 240 in the example used. The circuit also solves the problem of using thin-film transistors which have poor device performance characteristics such a low mobility and nonuniform threshold voltages and which can be deposited directly on the glass substrate.

As shown in FIG. 2, the row select driver circuit is divided into odd and even stages and each stage has eleven transistors. The output of stage 1 r1 is connected to the input of stage 2 at the gate of TFT M2 and to the first row line ROW1 of the pixel array. The output of stage 2 r2 is connected to the input of stage 3 and to the second row line ROW2 of the pixel array, and so forth through stage 240. All odd-numbered stages receive first, second and third control signals S1,o, S2,o, S3,o, respectively. All even-numbered stages receive fourth, fifth and sixth control signals S1,e, S2,e and S3,e, respectively. The seventh control signal S4 is connected to all stages. An eighth SDIN shift-in signal is connected to the first stage of the select driver circuit only. All stages are connected to two common grounds (or negative power supplies) VSS and VSS1 and a common positive power supply VCC. The reason to have two grounds is to separate the ground VSS for the output devices of each stage from the second ground VSS1 in order to provide noise immunity for the output. Thus, there are 11 input leads, namely: S1,o, S1,e, S2,o, S2,e, S3,o, S3,e, S4, SDIN, VCC, VSS and VSS1, from the external driving system connected to the row select driver circuit on the display device. It can be seen that only 11 control leads are needed to control 240 row select driver circuits as will be explained hereafter. If the interference to the output of each stage is not serious by combining VSS1 and VSS, then there are only 10 control leads needed. Separated negative power supply lines, VSS1 and VSS, will be used in the example described throughout the following description.

Figure 3:
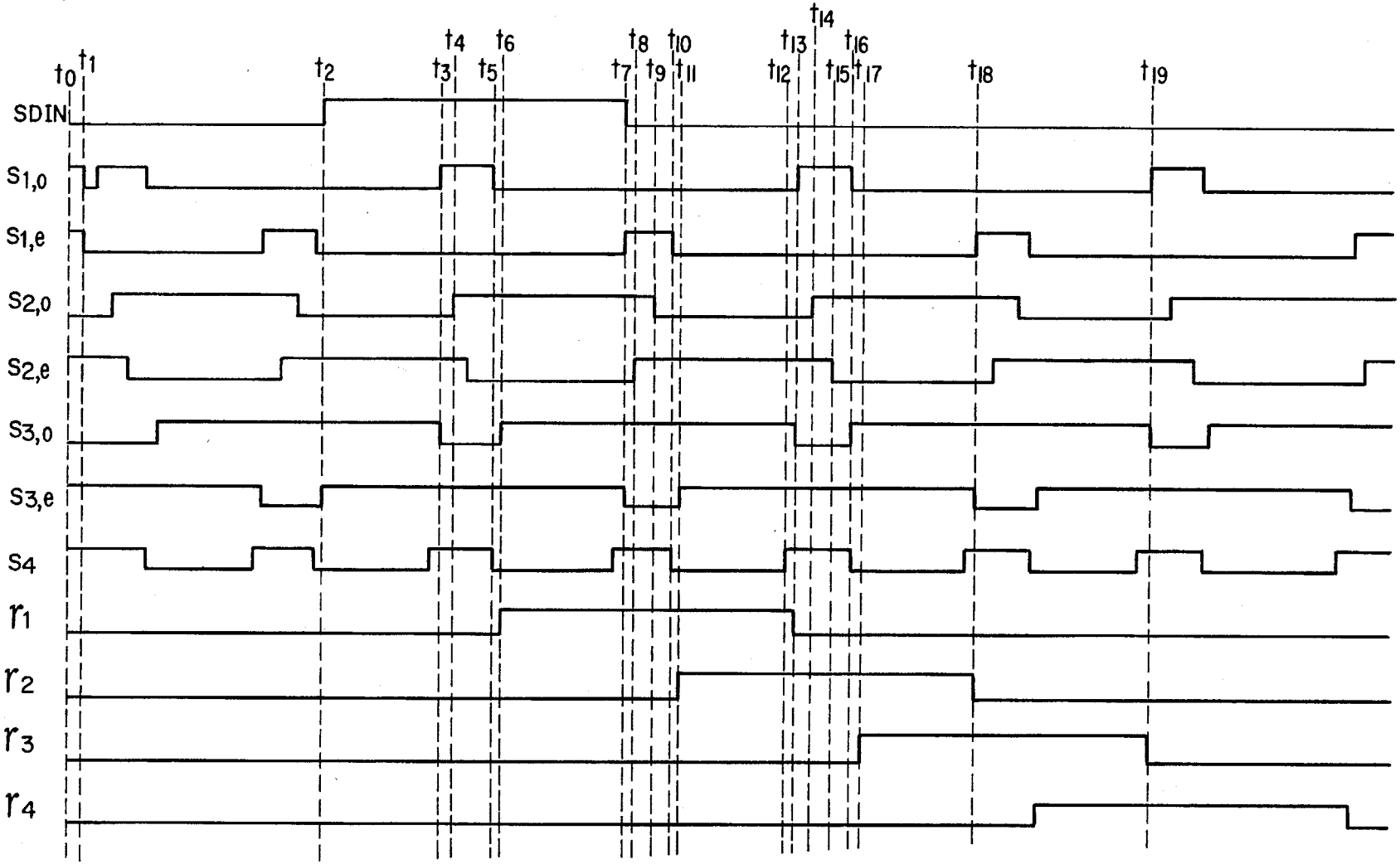
FIG. 3 is a timing diagram of the inputs and outputs to the circuit.

The waveform of the controlling clock signals and the signals at the internal and output nodes are shown in FIG. 3. The control signals S1,o, S1,e, S2,o, S2,e, S3,o, S3,e have a period which is twice as long as that of scanning line time, and S4 has a period of a scanning line time. The input shift-in signal SDIN has a period of a frame time. For this example using the NTSC system, the scanning line time width and the frame time width are approximately 63 us and 16.67 ms, respectively. The output of each stage is connected to a row of the display pixel gate line as shown in FIG. 1.

Video information (or other means of input signal to a display) is supplied to the system of FIG. 1 one row at a time. As those skilled in the art are aware, the low mobility (i.e. high on resistance) of the thin-film transistors in FIG. 2 slows down the charging and discharging time of the pixel capacitance through the TFT and effectively shortens the row-select time. In order to achieve a longer row-select time period to charge or discharge the pixel capacitance, the next adjacent row is activated before the previous row is deactivated. However, only one line of information is provided at one-time period, because only one pixel row is locked in at any given,horizontal line-time period. This operation is termed "line preselection". The advantage of the row-select driver circuitry is to reduce the number of external lead connections. In this example, the number of lead connections is reduced from 240 to 11 for the select driver alone. This lead reduction in turn significantly simplifies the display assembly and packaging. Although the novel circuitry requires 11 transistors per stage, the transistors are relatively small and easy to fabricate on a substrate such as glass. As a result, manufacturing cost is reduced because of the significant reduction of lead connections and fewer external driver chips.

As shown in FIG. 2 and the timing diagram of FIG. 3, the beginning of the operation spans from t0 to t1. The initialization pulses of S1,o and S1,e signals turn on transistors M1 in all stages, thereby causing all nodes al, a2, . . . , a240 to be charged to a high voltage (logical "1") level close to VDD or VCC, where VDD is the positive amplitude of S1,o and S1,e signals pulses. At this instant, all nodes a1, a2, . . . , a240 cause all transistors M5 and M7 to conduct, resulting in all nodes b1, b2, . . . , b240 and all output nodes r1, r2, . . . , r240 being discharged to the common ground levels VSS1 and VSS (low voltage or logical "0" level), respectively. Therefore, all scan lines for row 1 ROW1 through row 240 ROW240 are discharged to the vSS level at the beginning of the operation. However, it will be shown that these initialization pulses are optional.

Note that as long as an output node is at the low voltage level, the voltage variation at node d of the same stage has no effect on the corresponding output node, since the drain (source) of M8 is in common with the drain (source) of M7. It is assumed that the positive (negative) amplitude for each control signal is equal to VDD (VSS or VSS1) where VDD can be equal or close to VCC in magnitude.

Any control signal pulsing after t1 and before t2 has no effect on the output nodes since the nodes a's and b's remain high and low, respectively, during this time period. At time t2, the SDIN shift-in signal is pulsed high which turns on M2, M4 and M11 of stage 1. By turning M2 on, the node a1 is discharged to the VSS1 level while the nodes a2 through a240 remain at the high voltage level. Since M4 of stage 1 is conducting and S2,o is at the low voltage at t2, the node b1 remains at the low voltage level. The node d1 is at the low voltage at t2 since M11 is on.

At t3, the signal S1,o is pulsed high to turn on M1 of all odd-numbered stages. With M1 and M2 conducting in stage 1, the node al is charged to an intermediate voltage level between VDD and VSS1 depending on the transistor size ratio of M1 and M2. The signal S2,o is pulsed high at t4, causing the node b1 to be charged to an intermediate voltage level if the node a1 (which is at an intermediate voltage level) at this time is high enough to turn on M5 of stage 1. In any event, the potential of the node b1 at this point in time has no effect on the operation of the circuit since the signal S3,o is at the low voltage level.

At t5, the signal S1,o returns to the low voltage level, which turns off M1 of the stage 1, causing node a1 to be discharged to the low voltage level and turns off M5. In turn, the node b1 is charged to the high voltage level since M4 is still on and S2,o is at the high voltage level. Thus the node b1 is pulled up to a logical "1" level at t5 to turn on M6 of the stage 1. At time t6, the signal S3,o is raised to the VDD level, thereby causing the output node r1 to be charged to the high voltage (logical "1") level. During the period at which the node r1 is at a logical "1" level, all pixel transistors in row 1 of the pixel array in FIG. 1 are turned on. The transistor M11 of the stage 1 is used for holding the node d1 at a logical "0" level during the transition period of the output node r1 at t6.

Soon after r1 is charged to a logical "1" level, the transistors M2 and M4 of the stage 2 are turned on, causing the node a2 to be discharged to the VSS1 level and the node b2 to remain at the low voltage level since S2,e is at the low voltage level. After a scan time period of 63 us from t3 at time t7, the signal S1,e is pulsed high to turn on transistors M1 of all even-numbered stages. At this instant with M1 and M2 of the stage 2 conducting (because the output r1 of the stage 1 is at a logical "1" level), the node a2 is charged to an intermediate voltage level, similar to the node a1 at t3. The signal SDIN returns to the low voltage level t7, which is chosen arbitrarily because it is synchronized to the particular pulse of S3,e between t2 and t7 as shown in FIG. 3, thereby causing M2 and M4 of the stage 1 to be turned off with the nodes a1 and b1 still remaining at the low voltage and high voltage, respectively, and thus having no effect on the node r1. The falling edge of SDIN can be designed to occur at any time between t6 and t9 without affecting the node r1.

At t8 after a scan time period of 63us from t4, the signal S2,e is pulsed high causing the node b2 to be charged to an intermediate voltage level, similar to the node b1 at t4. The signal S2,o returns to the low voltage level at t9 and has no effect on the node b1 since M4 is already turned off at t7. The signal S1,e returns to the low voltage level at t10 and turns off M1 of the stage 2, thereby causing the node a2 to be discharged to the low voltage level (because r1 is at a logical "1" level), which in turn turns off M5 of the stage 2. Then the node b2 can be charged to the high voltage level since M4 of the stage 2 is still on and S2,e is at a high voltage level. With b2 high, M6 of the stage 2 is turned on at t10.

At t11, the signal S3,e is raised to the VDD level. With S3,e high and M6 of the stage 2 on, the output node r2 is pulled to a logical "1" level. During the period of time at which the node r2 is at a logical "1" level, all pixel transistors in row 2·ROW2 of pixel array in FIG. 1 are turned on. M11 of the stage 2 is on for the purpose of holding the node d2 at a logical "0" level during the transition period of the output node r2 at t11. Note that at time t11, both the output nodes r1 and r2 are at the logical "1" level as desired.

At t12, the signal S4 is raised to a logical "1" voltage level to turn on M9 of the stage 1 and to pull the node c1 to a the high voltage level while r2 is at the high voltage level. With the node c1 high, M10 of the stage 1 is turned on. AT time t13, 126 us (or twice the scan time period) after time t3, the signal S1,o is pulsed high again, causing the node d1 to be charged to a logical "1" level and turning on M8 of the stage 1. With S1,o high at t13, M1 of all the odd-numbered stages are turned on. Since M1 and M2 of the stage 1 are on and off, respectively, at t13, the node a1 is pulled to a logical "1" level, which turns on M3, M5 and M7 of the stage 1. By turning on M5 of the stage 1, the node b1 is discharged to the low voltage level. The signal S3,o can be returned to the low voltage level at t13 also. With M7 and M8 of the stage 1 turned on at t13, the output node r1 is discharged to the VSS level at t13, and thus a fast deselecting operation for row 1 at this instant is accomplished. M3 is connected so that it can provide a proper bias voltage to M5 and M7 of the same stage only at non-selecting periods of the corresponding row line.

Soon after r2 is pulled to a logical "1" level at t11, the transistors M2 and M4 of the stage 3 are turned on, thereby causing the node a3 to be discharged to the VSS1 level and the node b3 remaining at the low voltage level, since S2,o is at the low voltage level. Similar to the stage 1, as S1,o is pulsed high at t13, M1 is turned on while M2 is conducting in the stage 3, thereby causing the node a3 to be charged to an intermediate voltage level. The signal S2,o is pulsed high again at t14, which is 126 us (or twice the scanning line time) after t4, causing the node b3 to be charged to an intermediate voltage level, again similar to the operation occurring in the stage 1 at t4.

As r1 is pulled down to a logical "0" level, M2 and M4 of the stage 2 are turned off. At t15, the signal S2,e returns to the low voltage level, which has no effect on the node b2 because M4 of the stage 2 is already off at t13.

At t16, the signal S1,o returns to the low voltage level which turns off M1 of the stage 3, thereby causing the node a3 to be discharged to the low voltage level because r2 is at a logical "1" level. With a3 at a logical "0" level, M5 of the stage 3 is turned off and the node b3 is charged to the high voltage level, since M4 of the stage 3 is on and S2,o is at the high voltage level. The signal S3,o is raised to the VDD level at t17, a time period of 126 us after t6. Again, the sequence of the operation here is similar to the sequence of the operation occurring at the node r1 of the stage 1 at t6. Therefore, the output node r3 is pulled to a logical "1" level soon after S3,o is pulsed high at t17. During the period of time at which r3 is at a logical "1" level, all pixel transistors in row 3 of the pixel array in FIG. 1 are turned on. M11 of the stage 3 is turned on by the high voltage level at r2, thereby holding the node d3 at a logical "0" level during the transition period of the output node r3 at t13. Both the output nodes of r2 and r3 are at the high voltage level at t17.

In a similar fashion to the deselecting operation for row 1 at time tl3, row 2 and row 3 are deselected at time t18 and t19, respectively. As seen so far, the timing sequences of the control signals S1,e, S2,e and S3,e at the time period between t6 and t18 for the stage 2 have not only the same counterparts as S1,o, S2,o and S3,o in the stage 1 at the time period between t2 and t13, but also the same operation as the stage 1 (but with one scanning line time delay). Similarly, the same operation sequence is executed by the stage 3 at the time period between t11 and t19 as by the stage 1 at the time period between t2 and t13 (but with two scanning line time delay).

Each succeeding row select driver circuit operates in a similar fashion with the output of the previous stage providing an equivalent "shift-in" signal similar to the input signal SDIN to the first stage. All the subsequent stages remain in the off condition (logical "0" level) until these stages receive the high output signal from the previous stage. Therefore, the driver circuitry and the control signals during the remaining frame time shift the selection and deselection of the scanning lines row 4 through 240 sequentially in the same manner described above. It should be noted that a dummy stage 241 can be added to provide the output r241, which is not connected to the pixel array, to the drain electrode of M9 in stage 240. The drain electrode of M9 in stage 241 can be connected to VSS1.

It should be noted, as those skilled in the art may appreciate, the very first frame of display information after the power is turned on is usually ignored, because the first frame of display information is pulsed very quickly and does not adversely affect the display output. Therefore the initialization pulses of S1,o and S1,e are not needed in this case, since the output nodes are all at the low voltage level and all the other nodes are at known states at the end of the very first frame even without the initialization pulses of S1,o and S1,e in the beginning of the very first frame. Note that FIG. 3 only shows the timing diagram of the first few scan line times of a frame.

Power supplies VCC and VSS (VSS1) should all be adjusted according to the data driving scheme. For example, if a column inversion scheme is used, where the polarities of data voltage are reversed in alternate frames to effect a-c drive signals, a VCC of between 10 and 25 volts should be chosen and the ground line voltage level should then be between 0 and −10 volts. All ground lines, i.e. VSS and VSS1, are preferably but not necessarily kept separated from each other to reduce the noise introduced by the circuit.

As those skilled in the art can understand, the pulsewidths of the different control and clock signals are determined according to the timing budget of the operation, device characteristics and the sizes of the thin-film transistors. The size of the TFT should also be optimized to meet the performance requirements.

Figure 4:
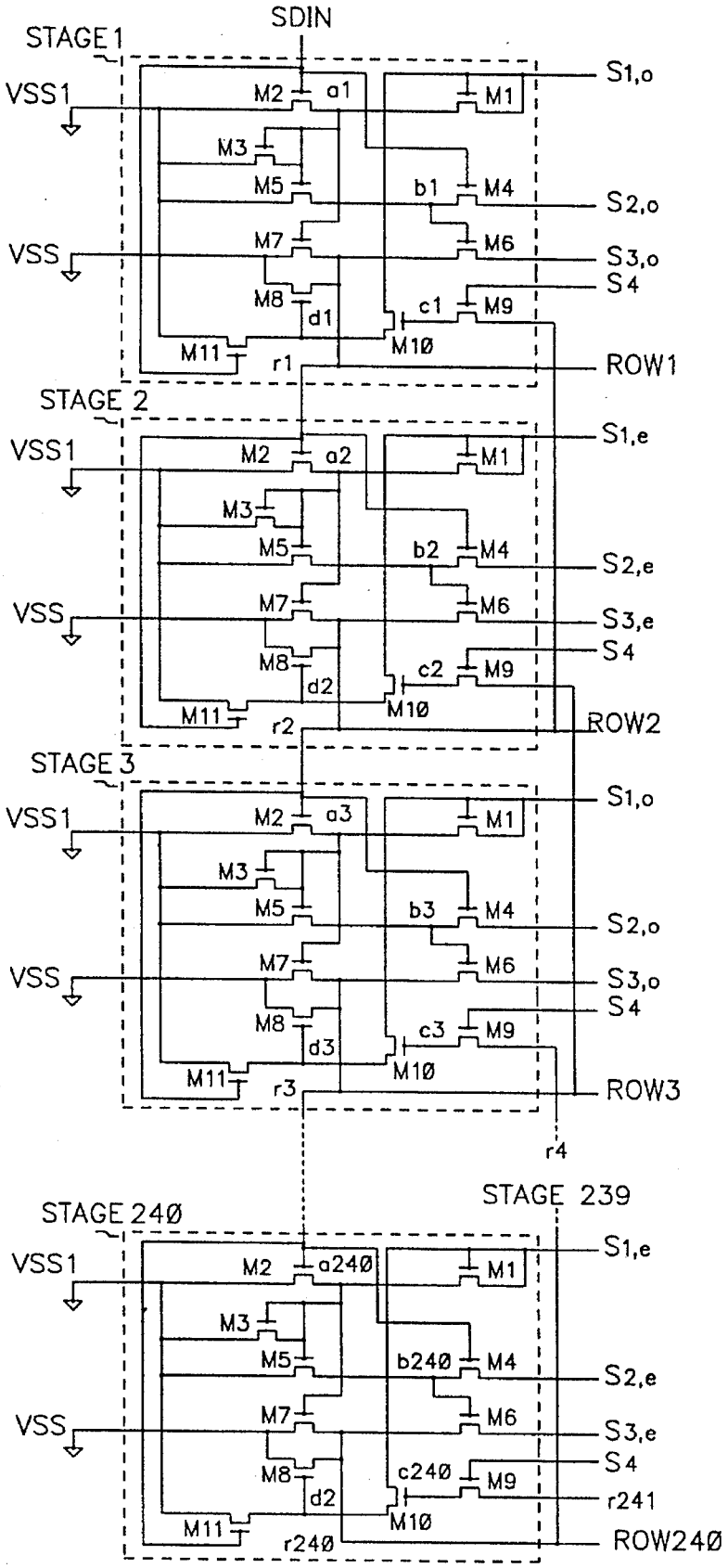
FIG. 4 shows the schematic diagram of another embodiment of the present invention.

Another embodiment of the present invention is shown in FIG. 4, which is an exact copy of the circuit in FIG. 2 except that the drain of M1 in each stage is connected to the gate of the same transistor. In other words, the drain is connected to either the S1,o or the S1,e signal depending on odd or even stage, instead of power supply VCC as shown in FIG. 2. In this way, one less external leads, i.e. 10 leads, are used for FIG. 4 as compared to 11 leads for FIG. 2, thus simplifying further the assembly and packaging. Furthermore, the performance of the circuit is not sacrificed because the drain of M1 is at the high voltage level whenever M1 is on, acting as if the drain were connected to VCC and because the node a is not affected by the drain voltage of M1 if M1 is off. Therefore, the output waveform generated by the circuit in FIG. 4 is essentially the same as the one generated by the circuit shown in FIG. 2.

The operation of the row select driver circuit in accordance with the present invention has been described in the foregoing paragraphs in relation to a scanning line time interval of 63 us for a 384×240 pixel array display interfacing with the NTSC television system. It should be understood that this is only an example of one embodiment of this invention. Other embodiments and timing schemes can be used without departing from concept of this invention. For example, displays other than for TV's or with greater or lesser resolution can be incorporated within the scope of the present invention.

Given that all the key timing and voltage level control signals are derived from external ICs, this circuit provides the convenience and flexibility for optimizing the display system. Furthermore, because of the simplicity of the circuit in operation, this row driver circuit integrated into the display substrate should result in a good production yield.

Thus, the circuits shown in FIGS. 1, 2 and 4 are for use with a display device wherein the display device contains a first number of pixel columns and a second number of pixel rows on the substrate. The circuit comprises a plurality of row select driver circuits that correspond to the number of pixel rows and electrically energize the pixel rows sequentially. The row select driver circuits are deposited on the display substrate and each circuit generates an output that is electrically connected to a corresponding pixel row and to a successive row select driver circuit as an activating input. Each of the row select driver circuits includes a plurality of thin-film transistors formed on the display substrate, normally a glass, and interconnected to cause sequential activation of each pixel row.

As explained previously, the first select driver circuit stage activates the first pixel row for a first predetermined period of time. A second adjacent row select driver circuit stage activates a subsequent pixel row for a second predetermined period of time prior to the termination of the first predetermined period of time such that a longer row select time is provided for each row to charge or discharge the pixels of the corresponding pixel row.

There has been disclosed a novel select driver circuit for a display device, particularly an LCD display, that employs thin-film transistors that can be deposited on a substrate such as glass together with the display TFT array, and which reduces the number of row driving input leads substantially, from some predetermined number such as 240 in the example given herein to 11 lines. Thus, the advantage of the disclosed driver circuitry is that it reduces the number of external lead connections and significantly solves the display (such as AMLCD) assembly and packaging problems due to the limitation of the connector pitch. Furthermore, it reduces the number of external driver ICs required for driving row lines.

What is claimed is;

1. A circuit for use with a liquid crystal display (LCD) wherein said LCD display contains a matrix of picture elements (pixel) arranged in a first number of pixel columns and second number of rows on a substrate, said circuit comprising:

a plurality of row select driver circuits corresponding to said number of pixel rows for electrically energizing said pixel rows, said row select driver circuits being deposited on the LCD display substrate, wherein an output of each of said row select driver circuits is electrically connected to a corresponding pixel row and to a succeeding row select driver circuit as an activating input; and switching means external to the LCD display and having leads electrically connected to said row select driver circuits for providing:

first set of three clock signals S1,o, S2,o, S3,o to all odd-numbered rows having a period twice as long as the horizontal scanning time of the display, second set of three clock signals S1,e, S2,e, S3,e to all even-numbered rows lagging said first set of three clock signals respectively by said horizontal scanning time, a seventh clock signal S4 having a period equal to the horizontal scanning time of the display, a shift-in clock signal SDIN coupled to only the input terminal of first row select driver circuit, said first set of three clock signals, second set of three clock signals, said seventh clock signal and said shift-in clock signals causing an output signal from each row select driver circuit such that each pixel row is sequentially energized.

2. The circuit of claim 1, wherein the leads from the switching means is less than the number of pixel rows.

3. The circuit of claim 1 wherein each of said row select driver circuits includes a plurality of thin-film transistors interconnected to cause sequential activation of each pixel row.

4. The circuit of claim 3 further including:

a first row select driver circuit stage activating a first pixel row for a first predetermined period of time; and a second adjacent row select driver circuit stage activating a subsequent pixel row for a second predetermined period of time such that a longer row select time is provided for each row to charge or discharge the pixels of the corresponding pixel row.

5. The circuit of claim 1 wherein the substrate is glass.

6. The circuit of claim 1 wherein:

the clock signal S2,o lags but overlaps partially with and has a pulsewidth wider than the clock signal S1,o, and the clock signal S3,o lags but overlaps partially with and has a pulsewidth wider than the clock signal S2,o.

7. The circuit of claim 1 wherein the output signal from each row select driver circuit energizes a corresponding pixel row and acts as a shift signal to the succeeding row select driver circuit.

8. The circuit of claim 7 wherein each row select driver circuit includes:

a transistor M1 and a transistor M2 connected in series between a positive power supply and a first negative power supply VSS1 with the gate of M1 connected to said S1,o clock signal for odd-numbered stages and to said S1,e clock signal for even-numbered stages, and with the gate of M2 connected to an input terminal;

a transistor M5 and a transistor M4 connected in series between said VSS1 and said clock signal S2,o for odd-numbered stages and to said S2,e signal clock for even-numbered stages, with:

the gate of M4 connected to said input terminal, the gate of M5 connected to the common node between M1 and M2, and to the drain and gate of a transistor M3 with the source connected to VSS1;

a transistor M7 and a transistor M6 connected in series between a second negative supply terminal VSS and said clock signal S3,o for odd-numbered stages or clock signal S3,e for even-numbered stages, with:

the gate of M7 connected to the common node between M1 and M2, the gate of M6 connected to the common node between M4 and M5, and the common node between M7 and M6 connected to said row output and the input terminal of the next stage;

a transistor M11 and a transistor M10 connected in series between said first negative supply terminal VSS1 and said clock signal S1,o for odd-numbered stages and said clock signal S1,e for even-numbered stages having:

the gate of M11 connected to said input signal, the common node of M11 and M10 connected to the gate of a transistor M8 with drain and source connected in parallel with the drain and source of the transistor M7;

a transistor M9 connected between the gate of M10 and the row output of succeeding stage, and having the gate of M9 connected to the clock signal S4.

9. A circuit of claim 8, wherein the first negative power supply terminal VSS1 and the second negative power terminal supply VSS are connected.

10. The circuit of claim 7, wherein each row select driver circuit includes:

a transistor M2 and a transistor M1 connected in series between a first negative power supply VSS1 and said S1,o clock signal for odd-numbered stages and S1,e clock signal for even-numbered stages, with the gate of M1 connected to the drain of M1 and with the gate of M2 connected to an input terminal;

a transistor M5 and a transistor M4 connected in series between said VSS1 and said clock signal S2,o for odd-numbered stages and to said S2,e clock signal for even-numbered stages, with:

the gate of M4 connected to said input terminal, the gate of M5 connected to the common node between M1 and M2, and to the drain and gate of a transistor M3 with the source connected to VSS1;

a transistor M7 and a transistor M6 connected in series between a second negative supply terminal VSS and said clock signal S3,o for odd-numbered stages or clock signal S3,e for even-numbered stages, with:

the gate of M7 connected to the common node between M1 and M2, the gate of M6 connected to the common node between M4 and M5, and the common node between M7 and M6 connected to said row output and the input terminal of the next stage;

a transistor M11 and a transistor M10 connected in series between said first negative supply terminal VSS1 and said clock signal S1,o for odd-numbered stages and said clock signal S1,e for even-numbered stages having:

the gate of M11 connected to said input signal, the common node of M11 and M10 connected to the gate of a transistor M8 with drain and source connected in parallel with the drain and source of the transistor M7;

a transistor M9 connected between the gate of M10 and the row output of succeeding stage, and having the gate of M9 connected to the clock signal S4.

11. A circuit of claim 10, wherein the first negative power supply terminal VSS1 and the second negative power terminal supply VSS are connected.

* * * * *